US007494390B2

(12) United States Patent
Mizutani

(10) Patent No.: US 7,494,390 B2
(45) Date of Patent: Feb. 24, 2009

(54) ACTION CONTROL DEVICE FOR SMALL BOAT

(75) Inventor: Makoto Mizutani, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/507,399

(22) Filed: Aug. 21, 2006

(65) Prior Publication Data

US 2007/0049139 A1 Mar. 1, 2007

(30) Foreign Application Priority Data

Aug. 19, 2005 (JP) ..... 2005-238450

(51) Int. Cl.

| | |
|---|---|
| ***B63H 5/20*** | (2006.01) |
| ***B63H 5/125*** | (2006.01) |
| ***B63H 20/08*** | (2006.01) |
| *B63H 21/22* | (2006.01) |
| *B63H 23/00* | (2006.01) |
| *B63H 25/04* | (2006.01) |
| *B63H 25/10* | (2006.01) |
| *B60L 1/14* | (2006.01) |
| *G05D 1/02* | (2006.01) |

(52) U.S. Cl. ..... 440/53; 440/1; 440/2; 114/144 R

(58) Field of Classification Search ..... 114/144 R, 114/144 RE; 440/1, 2, 84, 87, 61 R, 61 T, 440/53; 701/21

See application file for complete search history.

(56) References Cited

U.S. PATENT DOCUMENTS

| | | | |
|---|---|---|---|
| 2,215,003 | A | 9/1940 | Johnson |
| 2,224,357 | A | 12/1940 | Pecker |
| 3,084,657 | A | 4/1963 | Kiekhaefer |
| 3,233,691 | A | 2/1966 | De Biasi |
| 3,310,021 | A | 3/1967 | Shimanckas |
| 3,349,744 | A | 10/1967 | Mercier et al. |
| 4,120,258 | A | 10/1978 | Spurgin |
| 4,220,111 | A | 9/1980 | Krautkremer et al. |
| 4,373,920 | A | 2/1983 | Hall et al. |
| 4,500,298 | A | 2/1985 | Hall et al. |
| 4,519,335 | A | 5/1985 | Krautkremer et al. |

(Continued)

FOREIGN PATENT DOCUMENTS

| | | |
|---|---|---|
| JP | 62-166193 | 7/1987 |

(Continued)

OTHER PUBLICATIONS

Co-Pending U.S. Appl. No. 11/588,060, filed Oct. 25, 2006. Inventor: Mizutani. (submitted herewith) Title: Control Unit for Multiple Installation of Propulsion Units.

(Continued)

*Primary Examiner*—Lars A Olson
*Assistant Examiner*—Daniel V Venne
(74) *Attorney, Agent, or Firm*—Knobbe, Martens, Olson & Bear, LLP

(57) ABSTRACT

An action control device for a small boat can include a running condition detecting device, a running environment determining device configured to determine a running environment based upon the running condition, and a steering control device configured to set a steering handle operative characteristic in response to the running environment.

7 Claims, 7 Drawing Sheets

U.S. PATENT DOCUMENTS

| | | | | |
|---|---|---|---|---|
| 4,637,802 | A | 1/1987 | Taguchi et al. | |
| 4,787,867 | A | 11/1988 | Takeuchi et al. | |
| 4,872,857 | A | 10/1989 | Newman et al. | |
| 4,908,766 | A | 3/1990 | Takeuchi | |
| 4,909,765 | A | 3/1990 | Riske et al. | |
| 5,029,547 | A | 7/1991 | Novey | |
| 5,031,562 | A | 7/1991 | Nakase et al. | |
| 5,231,888 | A | 8/1993 | Katahira | |
| 5,235,927 | A | 8/1993 | Singh et al. | |
| 5,244,426 | A | 9/1993 | Miyashita et al. | |
| 5,253,604 | A | 10/1993 | Bohlin | |
| 5,361,024 | A | 11/1994 | Wisner et al. | |
| 5,370,564 | A | 12/1994 | Fujimoto et al. | |
| 5,533,935 | A | 7/1996 | Kast | |
| 5,800,223 | A | 9/1998 | Iriono et al. | |
| 5,997,370 | A | 12/1999 | Fetchko et al. | |
| 6,079,513 | A | 6/2000 | Nishizaki et al. | |
| 6,230,642 | B1 | 5/2001 | McKenney et al. | |
| 6,234,853 | B1 | 5/2001 | Lanyi et al. | |
| 6,273,771 | B1 | 8/2001 | Buckley et al. | |
| 6,402,577 | B1 | 6/2002 | Treinen et al. | |
| 6,405,669 | B2 | 6/2002 | Rheault et al. | |
| 6,471,556 | B1 | 10/2002 | Yamashita et al. | |
| 6,511,354 | B1 | 1/2003 | Gonring et al. | |
| 6,535,806 | B2 | 3/2003 | Millsap et al. | |
| 6,561,860 | B2 | 5/2003 | Colyvas | |
| 6,655,490 | B2 | 12/2003 | Andonian et al. | |
| 6,671,588 | B2 | 12/2003 | Otake et al. | |
| 6,678,596 | B2 | 1/2004 | Husain et al. | |
| 6,843,195 | B2 * | 1/2005 | Watabe et al. | 114/144 E |
| 6,855,014 | B2 | 2/2005 | Kinoshita et al. | |
| 6,892,661 | B2 | 5/2005 | Kishi et al. | |
| 6,892,662 | B2 | 5/2005 | Watanabe et al. | |
| 6,994,046 | B2 * | 2/2006 | Kaji et al. | 114/144 R |
| 6,997,763 | B2 * | 2/2006 | Kaji | 440/1 |
| 7,004,278 | B2 | 2/2006 | Sugitani et al. | |
| 7,063,030 | B2 | 6/2006 | Mizutani | |
| 2003/0077953 | A1 | 4/2003 | Kaji | |
| 2003/0150366 | A1 | 8/2003 | Kaufmann et al. | |
| 2003/0224670 | A1 | 12/2003 | Takada et al. | |
| 2003/0224672 | A1 | 12/2003 | Takada et al. | |
| 2004/0007644 | A1 | 1/2004 | Phelps et al. | |
| 2004/0031429 | A1 | 2/2004 | Kaufmann et al. | |
| 2004/0121665 | A1 | 6/2004 | Mizuguchi et al. | |
| 2004/0139902 | A1 | 7/2004 | Takada et al. | |
| 2004/0139903 | A1 | 7/2004 | Watabe et al. | |
| 2005/0118894 | A1 | 6/2005 | Kawanishi | |
| 2005/0121975 | A1 | 6/2005 | Gronau et al. | |
| 2005/0170712 | A1 | 8/2005 | Okuyama | |
| 2005/0170713 | A1 | 8/2005 | Okuyama | |
| 2005/0199167 | A1 | 9/2005 | Mizutani | |
| 2005/0199168 | A1 | 9/2005 | Mizutani | |
| 2005/0199169 | A1 | 9/2005 | Mizutani | |
| 2005/0215131 | A1 | 9/2005 | Oguma et al. | |
| 2005/0282447 | A1 | 12/2005 | Okuyama | |
| 2006/0019558 | A1 | 1/2006 | Mizutani et al. | |
| 2006/0037522 | A1 * | 2/2006 | Kaneko et al. | 114/55.52 |
| 2006/0180070 | A1 | 8/2006 | Mizutani | |
| 2006/0217012 | A1 | 9/2006 | Mizutani | |
| 2007/0066157 | A1 | 3/2007 | Yamashita et al. | |

FOREIGN PATENT DOCUMENTS

| | | |
|---|---|---|
| JP | 01-314695 | 12/1989 |
| JP | 02-179597 | 7/1990 |
| JP | 02-227395 | 9/1990 |
| JP | 03-148395 | 6/1991 |
| JP | 04-038297 | 2/1992 |
| JP | B-HEI 6-33077 | 5/1994 |
| JP | 2739208 B2 | 1/1998 |
| JP | 10-226346 | 8/1998 |
| JP | A-HEI 10-310074 | 11/1998 |
| JP | 2959044 B2 | 7/1999 |
| JP | 2000-313398 | 11/2000 |
| JP | 2000-318691 | 11/2000 |
| JP | 3232032 | 9/2001 |
| JP | A-2002-331948 | 11/2002 |
| JP | A-2004-155282 | 6/2004 |
| JP | 2005-254848 | 9/2005 |

OTHER PUBLICATIONS

Co-Pending U.S. Appl. No. 11/515,600, filed Sep. 5, 2006. Inventor: Mizutani. (submitted herewith) Title: Steering System for a Small Boat.

Co-Pending U.S. Appl. No. 11/516,151, filed Sep. 5, 2006. Inventor: Mizutani. (submitted herewith) Title: Steering Method and Steering System for Boat.

Co-Pending U.S. Appl. No. 11/593,393, filed Nov. 6, 2006. Inventor: Mizutani. (submitted herewith) Title: Electric Type Steering Device for Outboard Motors.

Co-pending U.S. Appl. No. 11/942,179, filed Nov. 19, 2007. Title: Watercraft Steering Device and Watercraft.

Co-pending U.S. Appl. No. 11/942,187, filed Nov. 19, 2007. Title: Watercraft Steering System, and Watercraft.

Co-pending U.S. Appl. No. 11/942,159, filed Nov. 19, 2007. Title: Watercraft Steering Device and Watercraft.

* cited by examiner (A)

(B)

| Fluctuation | Small | Medium | Large |
|---|---|---|---|
| Frequency | Low | Medium | High |
| Running Environment | A | B | C |

| Set Mode | 1 | 2 | 3 |
|---|---|---|---|
| Load of Steering Handle | Light | Light | Medium |
| Angle of Steering Movement | Large | Medium | Medium |

ACTION CONTROL DEVICE FOR SMALL BOAT

PRIORITY INFORMATION

This application is based on and claims priority under 35 U.S.C. §119 to Japanese Patent Application No. 2005-238450, filed on Aug. 19, 2005, the entire contents of which is hereby expressly incorporated by reference herein.

BACKGROUND OF THE INVENTIONS

1. Field of the Inventions

The present inventions relate to an action control device for a small boat having a propulsion unit such as, for example, an outboard motor and a stern drive.

2. Description of the Related Art

For example, Japanese Patent Document JP-B-2959044 discloses a boat having an electrically operated steering unit which is designed to provide smooth steering movement of the associated outboard motor. Japanese Patent Document JP-A-Hei 10-310074 discloses another steering device by which a force used to cause a pivotal movement of the propulsion unit of the outboard motor can be adjusted in response to running conditions, allowing the steering operation to be made with less force. Under a normal steering condition such as when a water surface is calm, it is preferable that such a power steering unit, which is operated electrically, provides a light steering force.

On the other hand, when a small boat encounters large waves, strong wind or the like, a position and/or orientation of the boat can change quickly. Consequently, the running resistance (e.g., the hydrodynamic resistance against the movement of the hull) and bilateral balance of the boat vary, which can make the riders of the boat uncomfortable. Quick steering adjustments can be used to counteract the external forces caused by the waves and wind and thus can reduce or inhibit listing (leaning) of the hull or other movements that can make the riders of the boat uncomfortable.

However, in some environments of use, such as fishing for example, the operator of the boat is normally stands near the steering wheel while operating the boat, in contrast to the position of a driver's seated position while driving a car. When such a boat rolls and bounces in rough water due to waves and/or strong wind, operators stand can become tired by continuously shifting their balance to compensate for the rolling and bouncing. Additionally, it can be difficult for an operator to quickly and accurately counteract the forces caused by the waves and wind.

In the art of land vehicles, Japanese Patent Document JP-A-2004-155282 discloses a steering unit which detects a drive condition of land vehicle such as, for example, a vehicle speed and a magnitude of acceleration and provides a drive environment in response to the detected values. Conventionally, however, no such means are available for assisting the steering operation of a boat by detecting an action of the boat.

SUMMARY OF THE INVENTION

An aspect of at least one of the embodiments disclosed herein include the realization that a boat can be configured to detect a running condition and to respond to the detected running conditions to make the boat operate in a more comfortable manner. For example, such a boat can make operation in rough water more comfortable.

In accordance with an embodiment disclosed herein, an action control device for a boat comprising a running condition detecting means, a running environment determining means for determining a running environment based upon the running condition, and a steering control means for setting a steering handle operative characteristic in response to the running environment.

In accordance with another embodiment, an action control device for a boat comprising a steering handle configured to allow an operator of a boat to input steering commands, a running environment detection device configured to determine a running environment of a boat, and a steering control device configured to adjust a steering handle operative characteristic in response to the running environment.

BRIEF DESCRIPTION OF THE DRAWINGS

These and other features and advantages of the inventions, features, aspects, and embodiments will become more apparent upon reading the following detailed description and with reference to the accompanying drawings of embodiments that exemplify the inventions disclosed herein.

DETAILED DESCRIPTION OF THE PREFERRED EMBODIMENT

Figure 1:
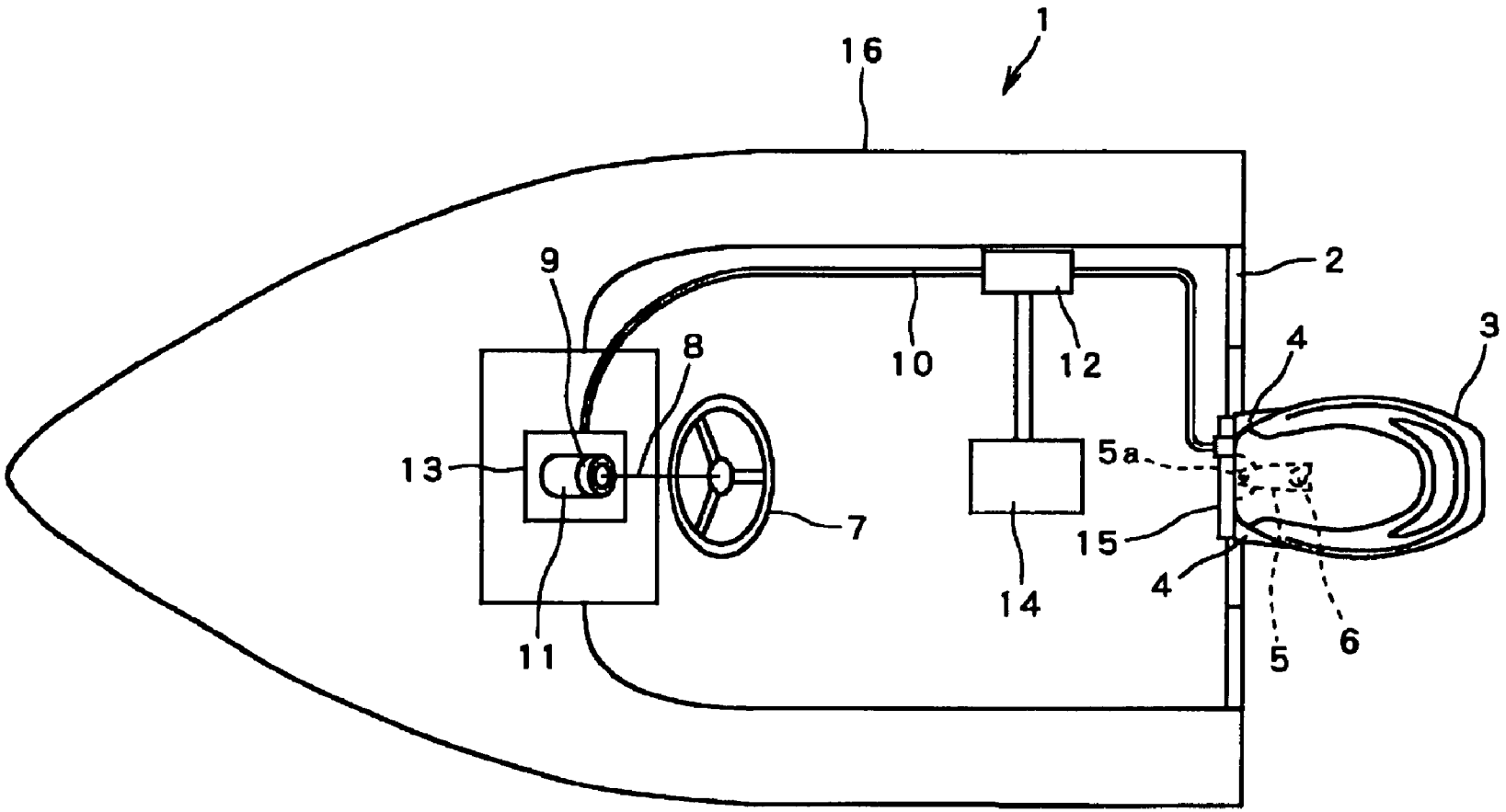
FIG. 1 is a schematic top plan view of a small watercraft configured in accordance with an embodiment.

FIG. 1 illustrates an outboard motor 3 mounted on a transom board 2 of a hull 16 of a boat 1 by a clamp bracket 4. The embodiments disclosed herein are described in the context of a small boat powered by an outboard motor because these embodiments have particular utility in this context. However, the embodiments and inventions herein can also be applied to other marine vessels, such as small jet boats, boats with inboard/outboard propulsion units or type of propulsion unit, as well as other vehicles.

The outboard motor 3 is pivotable about an axis of a swivel shaft (steering pivot shaft) 6 extending generally vertically. A steering bracket 5 can be fixed to a top end portion of the swivel shaft 6.

A steering unit 15 can be coupled with a front end portion 5*a* of the steering bracket 5. The steering unit 15 can be, for example, a DD (direct drive) type electric motor.

In the steering unit 15, a motor body (not shown) slides along a screw shaft (not shown) extending generally parallel to the transom board 2. The front end portion 5*a* of the steering bracket 5 is coupled with the motor body; and as such, the outboard motor 3 rotates about the axis of the swivel shaft 6 together with the slide movement of the motor body, described in greater detail below with reference to FIG. 3.

With continued reference to FIG. 1, a cockpit or operator's area of the hull 16 can include a steering handle 7 which can be in the form of a steering wheel or any other configuration.

A bottom of a steering shaft 8 of the steering handle 7 can communicate with a steering handle control unit 13.

The steering handle control unit 13 can include a steering angle sensor 9 configured to detect an angle of the steering handle and can include a reaction force motor 11. The steering handle control unit 13 can be connected to a control unit (ECU) 12 through a signal cable 10. The ECU 12 can also be connected to the steering unit 15.

Additionally, an action detecting unit 14 can be connected to the ECU 12. The action detecting unit 14 can include an engine speed sensor and a throttle valve opening sensor both of which can be used for controlling an engine of the outboard motor 3. The action detecting unit 14 can also include a position sensor, a vibration sensor, a yaw rate sensor and a speed sensor all for sensing conditions of the boat. These sensors can be individually connected to the ECU 12.

The ECU 12 can be configured to detect an amount of the steering operation, for example, an angle of the steering handle 7, based upon a detection signal delivered from the steering angle sensor 9. The ECU 12 can also be configured to transmit a command signal to the steering unit 15 in response to the steering operation amount and additionally in response to the running conditions including the speed, acceleration or deceleration states, etc. to drive the DD motor so that the outboard motor 3 rotates about the axis of the swivel shaft 6 and thus steers the boat 1.

Figure 2:
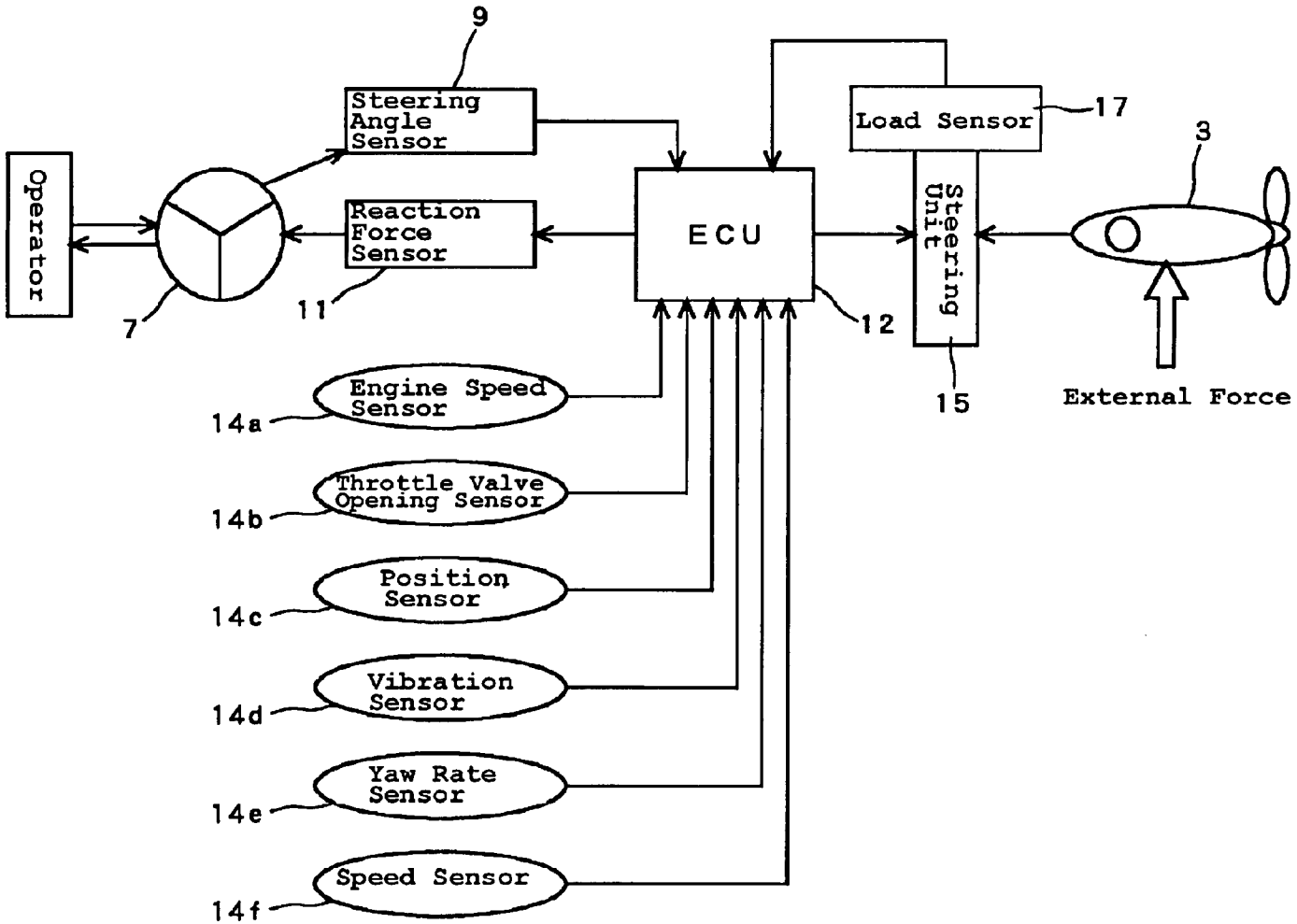
FIG. 2 is a block diagram showing a steering system configured in accordance with an embodiment and which can be used in conjunction with the boat of FIG. 1

With reference to FIG. 2, an external force can affect the outboard motor 3. The external force can be caused by wind or waves and a resistance force caused by the pivotal movement of the outboard motor 3. When the steering unit 15 rotates the outboard motor 3, the external force affects the steering unit 15 as a load against the pivotal movement of the outboard motor 3. A load sensor 17 can be configured to detect the load of the pivotal movement (external force). The load of the pivotal movement detected by the load sensor 17 can be input into the ECU 12.

During operation, when the operator steers the boat 1 by operating the steering handle 7, a steering angle sensor 9 detects an amount $\alpha$ of the pivotal operation of the steering handle 7. Detection information about the steering angle is input into the ECU 12. In addition, whenever the operator steers the boat 1, detection values of the engine speed sensor 14*a* and the throttle valve opening sensor 14*b* both for controlling the engine operation and detection values of the position sensor 14*c*, the vibration sensor 14*d*, the yaw rate sensor 14*e* and the speed sensor 14*f* for detecting the actions of the hull are input into the ECU 12.

The ECU 12 can be configured to compute an angle $\beta$ of the pivotal movement of the outboard motor 3 corresponding to a steering angle $\alpha$ of the steering movement of the steering handle 7 and based upon a pivotal movement characteristic of the outboard motor 3 which can be determined in response to running conditions determined by the information about the boat 1 and about the actions thereof.

The ECU 12 can be configured to compute a magnitude of reaction force corresponding to an operational amount of the steering handle 7 in response to the running conditions and the state of the external force while computing the angle $\beta$ of the pivotal movement of the outboard motor 3 and also controlling the engine operation. The ECU 12 can be configured to control a reaction force motor 11 to generate the reaction force and to provide the reaction force to the steering handle 7. For example, the ECU 12 reduces a load on the steering handle 7 (e.g., reduces the resistance to input from the operator) to make the steering feeling lighter which can improve a steering feeling in a normal running state. On the other hand, the ECU 12 can be configured to make the load of the steering handle 7 heavier to prevent the operator from suddenly and excessively rotating the steering handle 7 in rough weather.

As thus discussed above, the angle $\beta$ of the pivotal movement of the outboard motor 3 relative to the steering angle $\alpha$ and the load applied to the steering handle 7 are determined in response to the boat's running conditions etc. Thereby, an operative characteristic along which easy steerage is assured in accordance with the operating conditions of the boat 1 can be obtained.

A speed of the boat 1 can be determined by at least one of the following manners:

(a) Using a speed sensor: Such a speed sensor 14*f* can be, for example, a sensor measuring a rotational speed of an impeller, such as a paddle-wheel, fixed to the bottom of a boat to sense a speed relative to the water body, or a sensor using the GPS to sense a speed relative to the ground.

(b) Using detected engine speed: Because the boat's speed has correlation with the engine speed, the boat's speed can be determined when the engine speed is obtained. Engine speed data are input into the control unit because the engine speed is useful for controlling some aspects of engine operation. Accordingly, by the use of the engine speed data, the boat's speed can be detected without an additional speed sensor 14*f*.

(c) Using the detected throttle valve opening or a detected position of an accelerator lever: Because the speed of the boat 1 can be correlated with the throttle valve opening or the operational amount of the accelerator, the speed of the boat can be determined based on the throttle valve opening or the operational amount of the accelerator. Throttle valve opening data or the operational amount data of the accelerator can be input into the ECU 12 because the throttle valve opening or the operational amount of the accelerator can be used to control operation of the engine of the outboard motor 3. Accordingly, by the use of the throttle valve opening data or the operational amount data of the accelerator, the boat speed can be detected without the need for an additional speed sensor 14*f*.

(d) Using detected thrust force (engine torque). For example, a torque sensor provided around the crankshaft can be configured to detect the engine torque. Because the boat speed can be correlated with the thrust force, the boat speed can be determined based on the thrust force.

(e) Using an action of the boat such as a yaw rate, acceleration or the like: Because the boat speed can be correlated with an action of the boat, such as yaw rate, acceleration or the like, the boat speed can be determined based on the boat action.

Because the engine speed information discussed in the item (b) and the throttle valve opening information discussed in the item (c) are used for controlling the engine operation such as, for example, an ignition time control or a fuel injection control, those pieces of information are normally input into the ECU 12. By the use of the engine speed information and the throttle valve opening information for the control of the engine operation, the boat speed can be determined without requiring an additional sensor 14*f*.

Figure 3:
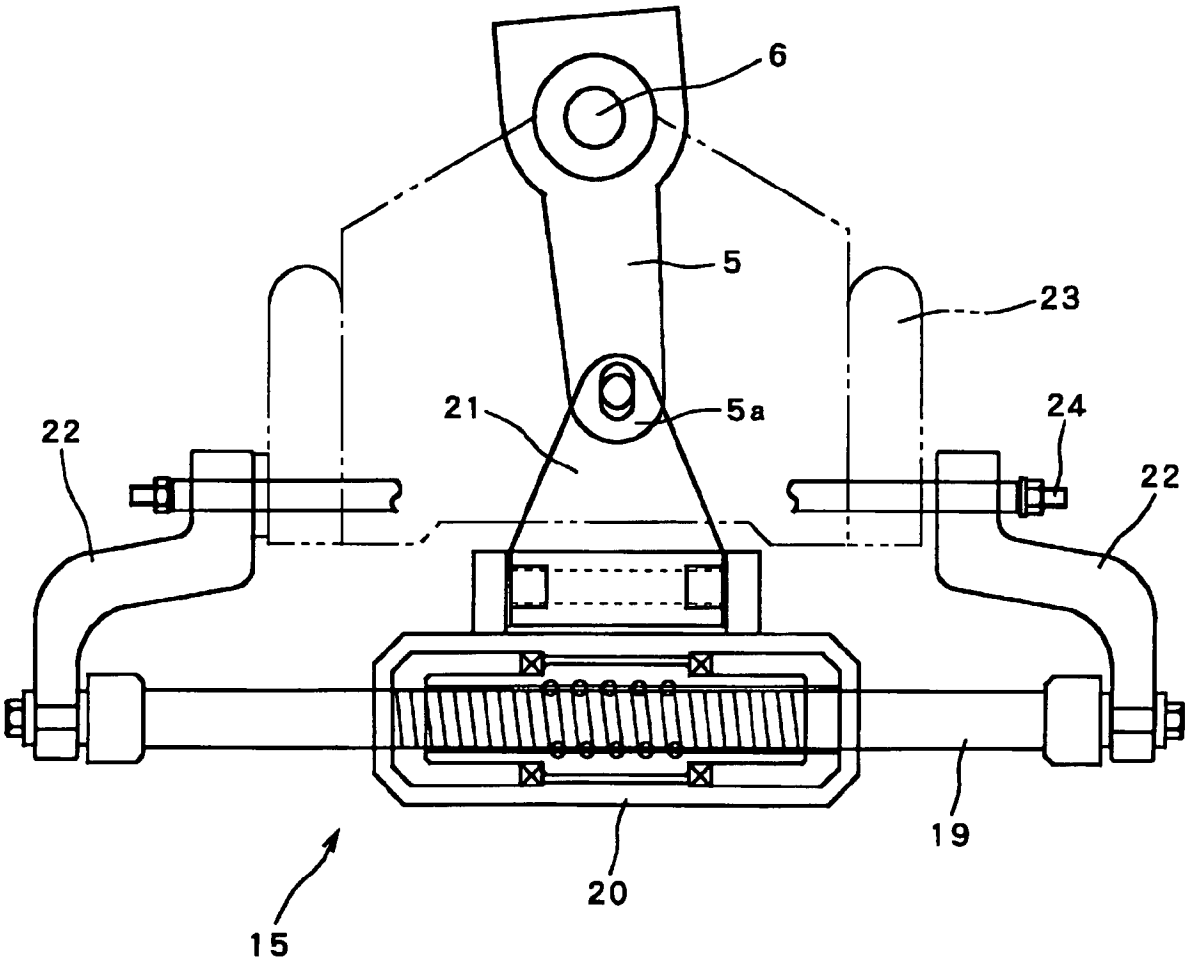
FIG. 3 is an enlarged schematic top plan and partial cutaway view of a steering unit that can be used with the boat of FIG. 1.

With reference to FIG. 3, the steering unit 15 can include an electric motor 20. The electric motor 20 can be mounted on a screw bar 19 and can be configured to slide along the screw bar 19.

Both ends of the screw bar 19 can be fixed to the transom board (not shown in FIG. 3) of the boat 1 through support members 22. A reference numeral 23 indicates clamp portions of the clamp bracket, and a reference numeral 24 indicates a tilt shaft.

A steering bracket 5 can be fixed to the swivel shaft 6 of the outboard motor 3 (FIG. 1). The electric motor 20 can be coupled with a front end portion 5*a* of the steering bracket 5 through a coupling bracket 21.

In such a structure, by sliding the electric motor 20 along the screw bar 19 in response to the steering amounts of the steering handle, the outboard motor can pivot about the axis of the swivel shaft 6, and thereby steer the boat 1.

Figure 4:
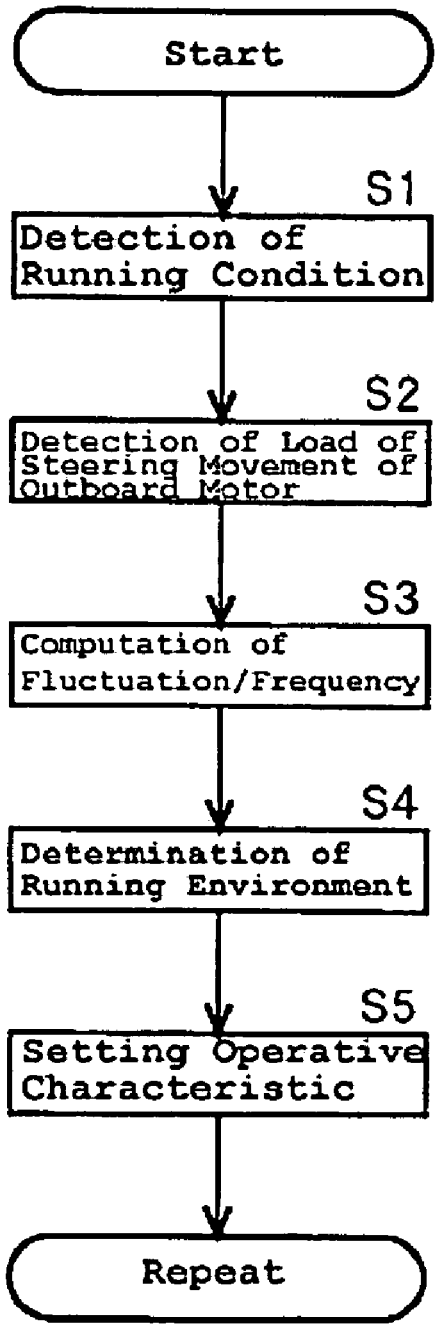
FIG. 4 is a flowchart of a routine that can be used in conjunction with the boat and steering units illustrated in FIGS. 1-3.

FIG. 4 illustrates a control routine that can be used with the steering unit 15. However, the control routine of FIG. 4 can also be used with other steering units.

With regard to the control routine of FIG. 4, it is to be understood that although it is referred to as a "control routine," this routine can be part of a larger control routine that controls other aspect of operation of the boat 1 or it can be an independent routine. Additionally, the functions of the control routine can be provided in any known manner, for example, a device that is configured to perform the routine of FIG. 4 can be in the form of a hard wired feedback control circuit. Alternatively, such a device can be constructed of a dedicated processor and a memory for storing a computer program configured to perform the routine of FIG. 4. Additionally, the device can be constructed of a general purpose computer having a general purpose processor and the memory for storing the computer program for performing the routine of FIG. 4 and optionally one or more other routines. Preferably, however, the device or "module" configured to perform the routine of FIG. 4 is incorporated into the ECU 12, in any of the above-mentioned forms.

Figure 5:
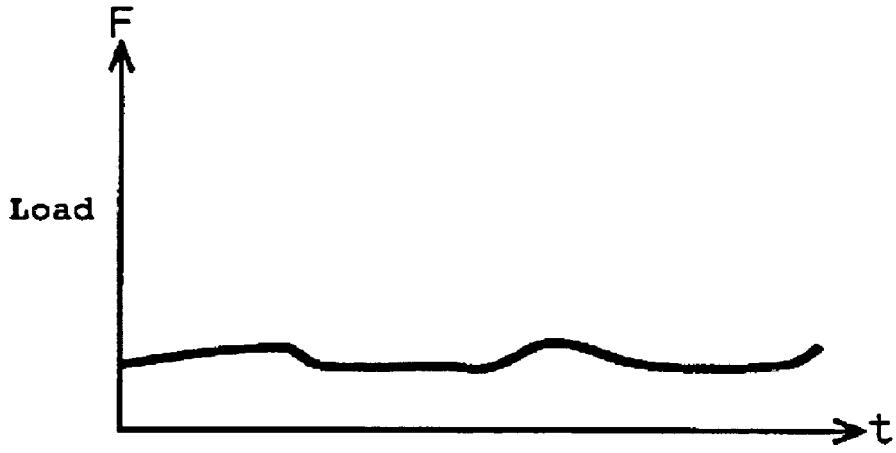
FIGS. 5(A) and 5(B) includes graphs illustrating exemplary changes in load over time during operation of the boat, steering units, and/or the control routine of FIGS. 1-4.
Figure 5:
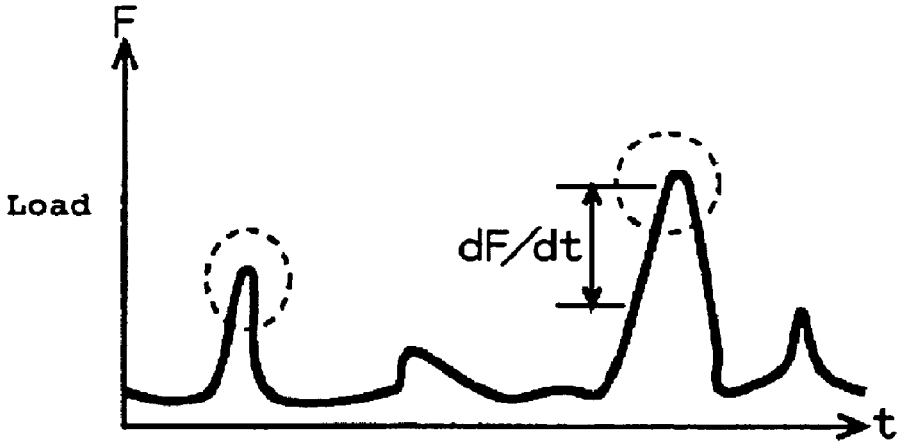

With reference to FIG. 4, in Step S1, a running condition of the boat 1 is determined. For example, but without limitation, the sensors 14*a*-14*f* (FIG. 2) can be used to detect the boat running conditions including a position, a vibration, a yaw rate, a speed, etc. of the hull 16. One or more of these or other conditions can be used in a determination of an "action" of the boat 1, described in greater detail below with reference to FIG. 5. After Step 1, the routine moves to Step S2.

In Step S2, a load of the pivotal movement of the outboard motor 3 can be determined. For example, the output of the load sensor 17 (FIG. 2) can be used as an indication of the pivotal load on the outboard motor 3.

FIGS. 5(A) and 5(B) show examples of a determination of an action of the hull 16 according to detection values of the load sensor 17. The vertical axis in these figures indicates an external force F, while the horizontal axis indicates time.

FIG. 5(A) shows a state in which the load (external force F) scarcely fluctuates, i.e., it shows a condition under which the boat runs gently because of the absence of large wave and strong wind. On the other hand, FIG. 5(B) shows abrupt vertical fluctuations of the load, particularly in the dotted circles, i.e., it shows another condition under which the boat runs in rough weather such as larger waves and stronger winds. The ECU 12 can be configured to rank the running environment based upon frequencies of the abrupt fluctuations of the load, a change (differential) dF/dt of the external force F, etc.

With continued reference to FIG. 4, in Step S3 the respective frequencies and fluctuation amounts are computed based upon the detection values obtained at Steps S1 and S2. The ECU 12 (FIG. 2) can determine such frequencies and fluctuation amounts. After the Step S3, the routine can move to Step S4.

In Step S4, a running environment of the hull can be determined based upon the computed result of Step S3. The ECU 12 (FIG. 2) can be configured to determine the running environment. After the Step S4, the routine can move to Step S5.

In Step S5, an operative characteristic can be determined based upon the running environment. The ECU 12 (FIG. 2) can be configured to determine the operative characteristic.

Figure 6:
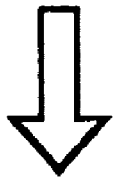
FIG. 6 is a chart illustrating exemplary settings that cab be used in conjunction with the boat, steering units, and/or the control routine of FIGS. 1-4.

FIG. 6 shows an exemplary but non-limiting examples of how the ECU 12 can provide the results of the determination of the running environment conducted at Step S4 and an example of set modes of the operative characteristic obtained at Step S5. For example, fluctuation amounts such as those shown in FIG. 5(B) can be classified into three grades of small, medium and large, and the frequencies of the respective fluctuations can be classified into three grades of low, medium and high. However, other classifications can also be used.

The running environment can be classified into three ranks of A, B and C in accordance with the result of the classifications of the fluctuation amounts and the frequencies. However, other classifications can also be used. Afterwards, modes of the operative characteristic can be set in accordance with the respective ranks.

For instance, when the fluctuation of the load is small and the frequency of the fluctuation is low, the running environment is ranked at A, and a set mode 1 is given to the running environment of the rank A. In the set mode 1, the load applied to the steering handle is light and an angle of the pivotal movement of the outboard motor is large relative to the steering angle. As such, the operator can operate the steering handle smoothly and lightly under the calm condition of the rank A.

When the fluctuation of the load is medium and the frequency thereof is medium, the running environment is ranked at B, and a set mode 2 is selected. Under this condition, the operator can operate the steering handle lightly, but the angle of the pivotal movement of the outboard motor relative to the steering angle is set to "medium" which provides smaller movements of the outboard motor 3 relative to the steering angle.

Finally, when the fluctuation of the load is large and the frequency thereof is high, the running environment is ranked at C, and a set mode 3 is selected. In the set mode 3, the load applied to the steering handle 7 is medium which corresponds to a greater load than that applied to the steering handle 7 in the light setting. Additionally, in set mode 3, the angle of the pivotal movement of the outboard motor 3 is also medium. Thereby, the excessive rotation of the steering handle 7 or the unintentional turn of the boat 1 due to the excessive rotation of the steering handle 7, i.e., due to the excessively large angle of the pivotal movement of the outboard motor 3 in rough weather can be avoided.

Such ranks of the running environment and varieties of the set modes are not limited to the example of FIG. 6. Larger number of patterns of the operative characteristics can be set by previously programming them in the control unit. Further, the determination that a size or magnitude of a fluctuation is "small", "medium", or "large" and the determination that the frequency is "low", "medium", or "high" can be made with reference to predetermined thresholds. Such thresholds can be determined through routine experimentation.

The routine of the Steps S1 through S5 discussed above can be repeated; thereby, the operator can steer the boat always in response to the various running environments.

FIGS. 7(A)-(D) include graphs (in solid line) illustrating exemplary but non-limiting effects provided under the settings of the operative characteristics discussed above. In the figures, chain double-dashed lines indicate running conditions resulting when the operative characteristics are not used in the controls.

Figure 7:
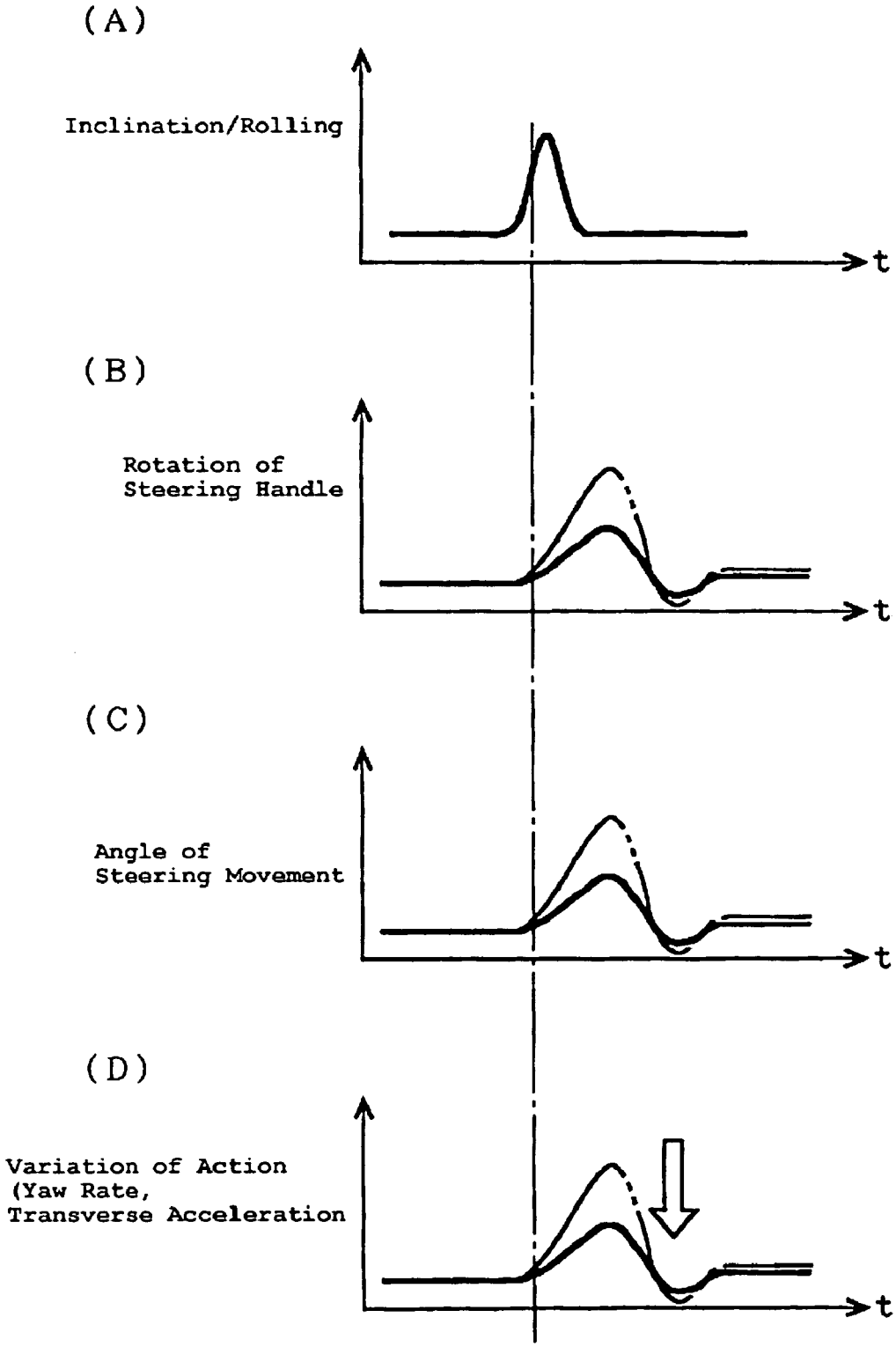
FIGS. 7(A), 7(B), 7(C), and 7(D) are timing diagrams illustrating exemplary changes in certain characteristics that can result during use of the the boat, steering units, the control routine and/or the settings of FIGS. 1-6.

(A) As shown in FIG. 7(A), when the inclination, rolling or the like of the hull 16 is detected, in response to the magnitude thereof, the load applied to the steering handle 7 (e.g., providing a resistance to movement of the steering handle) is controlled to become heavier than a normal load. With the load of the steering handle becoming heavier, the operator is less likely to excessively turn the steering handle 7 beyond a desired position, even the operator moves to compensate for larger movements of the hull 16, for example, in larger, waves or stronger winds. As such, as indicated by the solid line of FIG. 7(B), the rotational movement of the steering handle 7 is likely to be smaller because it takes more force or effort to rotate the steering handle 7.

Further, as shown in FIG. 7(C), the angle of the pivotal movement of the outboard motor relative to the steering angle adjusted to be smaller. Accordingly, as shown in FIG. 7(D), the variation of the actions of the boat which include the yaw rate, transverse acceleration or the like becomes smaller. The hull 16 thus becomes more stable.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An action control device for a boat comprising a steering handle, a propulsion device, a running condition detecting means, a running environment determining means for determining a running environment based upon the running condition, and a steering control means for setting a steering handle operative characteristic in response to the running environment, wherein the running condition includes at least one of a vibration of the hull and a yaw rate of the hull, wherein the steering control means includes means for raising a reaction force applied to a steering handle and to increase a ratio of a steering movement of the steering handle and a steering movement of the propulsion device when a frequency and variations in environmental forces acting on the propulsion device indicate that the boat is being operated in more severe conditions.

2. The action control device for a boat according to claim 1, wherein the running condition additionally includes at least one of a position of the hull, a speed and a load of pivotal movement of the propulsion unit, and the running environment is determined based upon a variation of the running condition and a frequency of the variation.

3. An action control device for a boat comprising a running condition detecting means, a running environment determining means for determining a running environment based upon the running condition, a steering control means for setting a steering handle operative characteristic in response to the running environment, a propulsion unit mounted on a hull of the boat, a steering handle adapted to be operated by a human operator, a steering angle sensor for detecting a steering angle of the steering handle, a steering unit configured to pivot the propulsion unit relative to the hull in response to the steering angle, a load sensor configured to detect a load of the pivotal movement of the propulsion unit, a reaction force motor configured to apply a reaction force to the steering handle in response to the load of the pivotal movement of the propulsion unit, and a control unit configured to compute a pivotal movement angle of the propulsion unit by the steering unit based upon the steering angle of the steering handle and a pivotal movement characteristic of the propulsion unit, the control unit forming the running environment determining means and the steering control means.

4. The action control device for a boat according to claim 3, wherein the running environment is determined based upon the load of the pivotal movement of the propulsion unit.

5. The action control device for a boat according to claim 3, wherein, when the running environment is determined to be more severe, the reaction force applied to the steering handle is made heavier and a ratio of the pivotal movement angle of the propulsion unit is decreased relative to the steering angle.

6. An action control device for a boat comprising a steering handle configured to allow an operator of a boat to input steering commands, a propulsion device, a running environment detection device configured to determine a running environment of a boat, and a steering control device configured to adjust a steering handle operative characteristic in response to the running environment, wherein the running environment detection device is configured to detect a magnitude of a variation of a running condition of a boat, wherein the steering control device is configured to raise a reaction force applied to the steering handle and to increase a ratio of a steering movement of the steering handle and a steering movement of the propulsion device when a frequency and variations in environmental forces acting on the propulsion device indicate that the boat is being operated in more severe conditions.

7. An action control device for a boat comprising a steering handle configured to allow an operator of a boat to input steering commands, a running environment detection device configured to determine a running environment of a boat, and a steering control device configured to adjust a steering handle operative characteristic in response to the running environment, wherein the running environment detection device is configured to detect a magnitude and a frequency of variations of environmental forces acting on to a propulsion device of a boat, the steering control device being configured to change the steering handle operative characteristic if the magnitude and frequency exceed a predetermined threshold, wherein the steering handle operative characteristic is at least one of a reaction force applied to the steering handle and the ratio of a steering movement of the steering handle to a steering movement of the propulsion device wherein the steering control device is configured to raise a reaction force applied to the steering handle and to increase the ratio when frequency and variations in environmental forces acting on the propulsion device indicate that the boat is being operated in more severe conditions.

* * * * *